US009099806B2

(12) United States Patent
Wang

(10) Patent No.: US 9,099,806 B2
(45) Date of Patent: Aug. 4, 2015

(54) CONNECTOR ASSEMBLY

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventor: Shi-Chao Wang, Wuhan (CN)

(73) Assignees: HONG FU JIN PRECISION INDUSTRY (WuHan) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 15 days.

(21) Appl. No.: 14/157,539

(22) Filed: Jan. 17, 2014

(65) Prior Publication Data

US 2015/0171549 A1 Jun. 18, 2015

(30) Foreign Application Priority Data

Dec. 12, 2013 (CN) ..... 2013 1 06727087

(51) Int. Cl.
*H01R 11/30* (2006.01)
*H01R 13/62* (2006.01)
*H01R 13/64* (2006.01)

(52) U.S. Cl.
CPC ..... *H01R 13/6205* (2013.01); *H01R 13/64* (2013.01)

(58) Field of Classification Search
CPC ..... H01R 11/30
USPC ..... 439/39, 289
See application file for complete search history.

(56) References Cited

U.S. PATENT DOCUMENTS 5,941,729 A * 8/1999 Sri-Jayantha ..... 439/505
2007/0184674 A1* 8/2007 Koch ..... 439/39

* cited by examiner

*Primary Examiner* — Abdullah Riyami
*Assistant Examiner* — Nelson R Burgos-Guntin
(74) *Attorney, Agent, or Firm* — Novak Druce Connolly Bove + Quigg LLP

(57) ABSTRACT

A connector assembly includes a male connector and a female connector. An inserting portion and first and second magnets protrude from an end surface of the male connector. The polarities of the first magnet and the second magnet are reversed. A receiving portion is formed at an end of the female connector to be electrically connected to the inserting portion. A first fixing member and a second fixing member at opposite sides of the receiving portion protrude from an end surface of the female connector. Two rods coiled with coils are formed inside the female connector and are electrically connected to the first and second fixing members. When the coils are electrified, the first and second fixing members turn to have reverse polarities. The polarities of the first magnet and the first fixing member are reverse. The polarities of the second fixing member and the second magnet are reverse.

6 Claims, 3 Drawing Sheets

CONNECTOR ASSEMBLY

BACKGROUND

1. Technical Field

The present disclosure relates to a connector assembly.

2. Description of Related Art

Male connectors are easily wrongly connected to female connectors. As a result, the male connectors need to be disengaged from the female connectors, and then reinserted into the female connectors, which is inconvenient.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
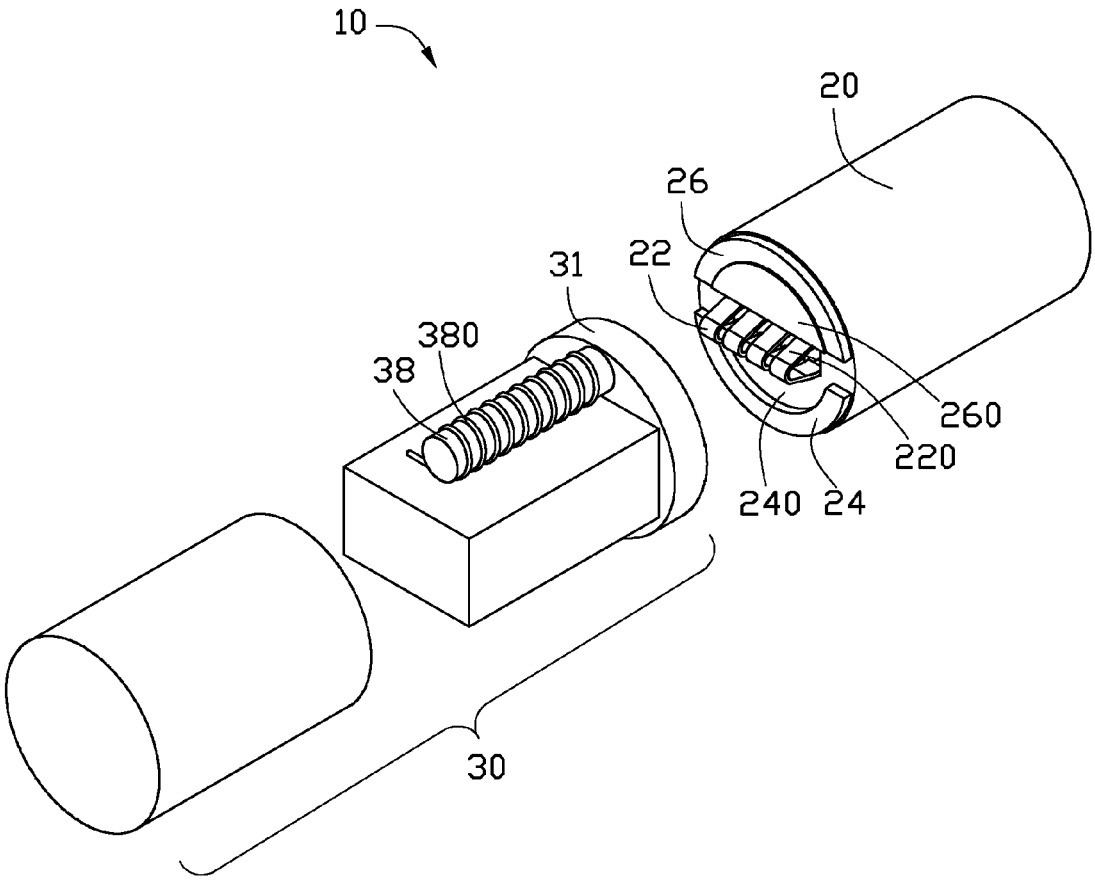
FIG. 1 is an exploded, isometric view of an embodiment of a connector assembly.
Figure 2:
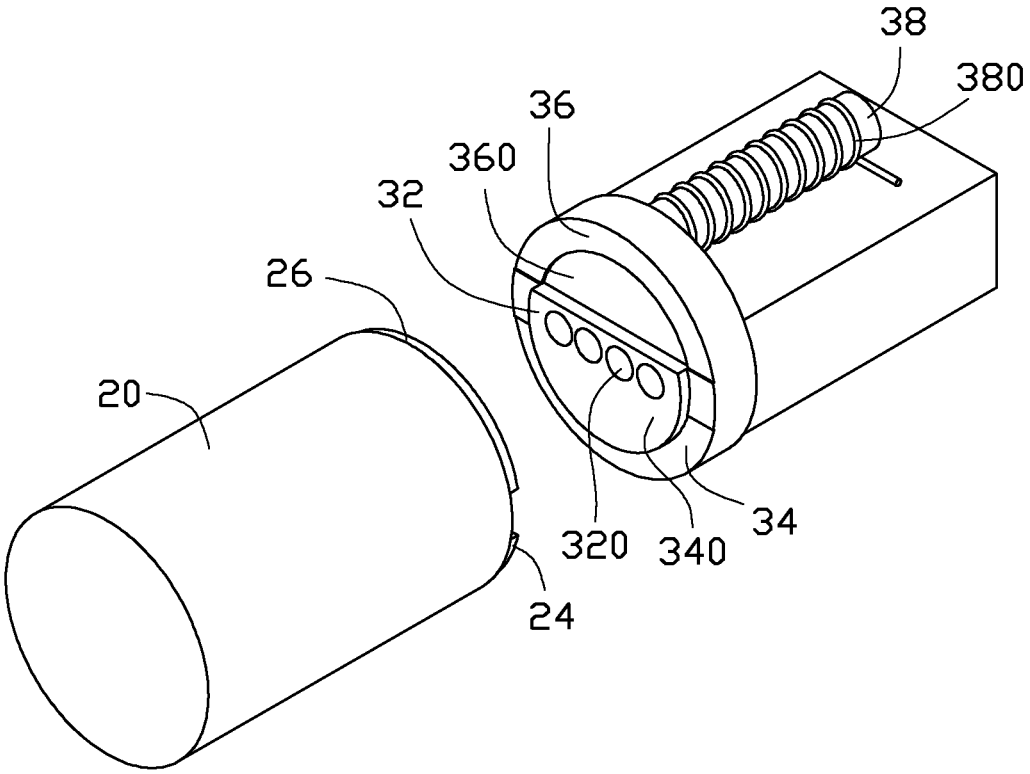
FIG. 2 is similar to FIG. 1, but viewed from another perspective.

FIGS. 1 and 2 show an embodiment of a connector assembly 10. The connector assembly 10 comprises a male connector 20 and a female connector 30.

An inserting portion 22, and a first magnet 24 and a second magnet 26 at opposite sides of the inserting portion 22 protrude from an end surface of the male connector 20. The inserting portion 22 comprises a plurality of V-shaped metal piece connecting portions 220. The first and second magnets 24 and 26 are arc-shaped, and extend along a circumference of the end surface of the male connector 20. A first positioning hole 240 is bound by the inserting portion and the first magnet 24. A protrusion 260 protrudes from the end surface of the male connector 20 between the second magnet 26 and the inserting portion 22. The protrusion 260 is a greater height than the second magnet 26. The polarities of the portions of the first magnet 24 and the second magnet 26 opposite to the end surface of the male connector 20 are reversed.

A receiving portion 32 is formed at an outer surface of an end portion 31 of the female connector 30. A first fixing member 34 and a second fixing member 36 at opposite sides of the receiving portion 32 protrude from the outer surface of the end portion 31 of the female connector 30. The first and second fixing member 34 and 36 are arc-shaped, and extend along a circumference of the outer surface of the end portion 31. The receiving portion 32 defines a plurality of receiving holes 320, each receiving hole 320 receives a metal piece (not shown) electrically connected to the circuit inside the female connector 30. A block 340 protrudes from the outer surface of the end portion 31 between the first fixing member 34 and the receiving portion 32. The block 340 is connected to the receiving portion 32. A top surface of the block 340 is coplanar with a top surface of the receiving portion 32. The block 340 is greater than the first fixing member 34 in height. A second positioning hole 360 is bound by the receiving portion 32 and the second fixing member 36.

Two conductive rods 38 are formed inside the female connector 30 and are perpendicularly connected to the first and second fixing members 34 and 36, respectively. Each rod 38 is coiled with a coil 380. The coils 380 are coiled to the rods 38 in opposite directions and are connected to the circuit inside the female connector 32.

The first fixing member 34, the second fixing member 36, and the rods 38 are made of iron or silicon steel.

Figure 3:
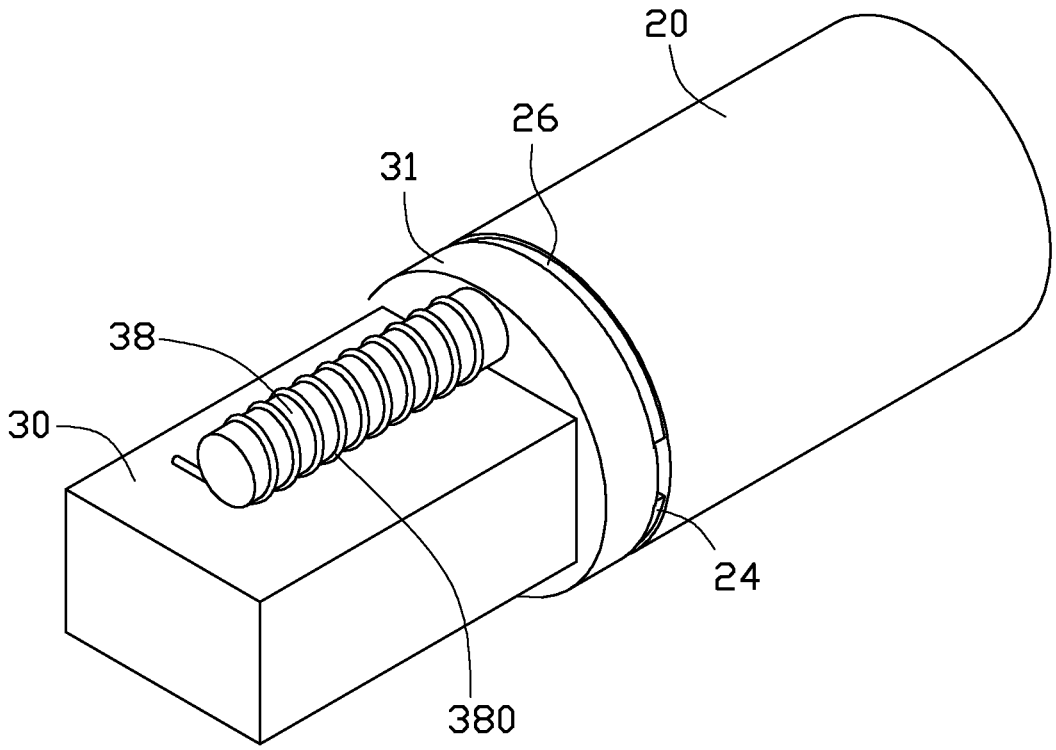
FIG. 3 is a partly, assembled view of FIG. 1.

FIG. 3 shows that when the coils 380 are electrified, the first and second fixing members 34 and 36 turn to have reverse polarities. The polarities of the first magnet 24 and the first fixing member 34 are reverse. The polarities of the second fixing member 36 and the second magnet 26 are reverse.

At this time, when the male connector 20 is wrongly inserted into the female connector 30, the female connector 30 may reject the male connector 20. When the male connector 20 is rightly inserted into the female connector 30, the inserting portions 220 will be magnetically held in the receiving holes 320 and electrically connected to the metal pieces received in the receiving holes 320. The protrusion 260 is engaged in the second positioning hole 360. The block 340 is engaged in the first positioning hole 240. The first fixing member 34 is attracted to the first magnet 24, and the second fixing member 36 is attracted to the second magnet 26, to prevent the male connector 20 from disengaging from the female connector 30.

It is believed that the present embodiments and their advantages will be understood from the foregoing description, and various changes may be made thereto without departing from the spirit and scope of the description or sacrificing all of their material advantages, the examples hereinbefore described merely being exemplary embodiments.

What is claimed is:

1. A connector assembly, comprising:

a male connector comprising an inserting portion, and a first magnet and a second magnet at opposite sides of the inserting portion, wherein the inserting portion and the first and second magnets protrude from an end surface of the male connector, polarities of portions of the first magnet and the second magnet opposite to the end surface of the male connector are reverse; and a female connector comprising a receiving portion formed at an end surface of the female connector to be electrically connected to the inserting portion, a first fixing member and a second fixing member at opposite sides of the receiving portion protruding from the end surface of the female connector, and two conductive rods formed inside the female connector and electrically connected to the first and second fixing members, respectively, wherein each rod is coiled with a coil, the coils are coiled to the rods in opposite directions, when the coils are electrified, the first and second fixing members turn to have reverse polarities;

wherein the polarities of the first magnet and the first fixing member are contrary; and the polarities of the second fixing member and the second magnet are contrary.

2. The connector assembly of claim 1, wherein the first magnet and the inserting portion bound a first positioning hole, the female connector further comprises a block between the first fixing member and the receiving portion to be engaged in the first portioning hole.

3. The connector assembly of claim 2, wherein the second fixing member and the receiving portion bound a second positioning hole, the male connector further comprises a protrusion between the first magnet and the inserting portion to be engaged in the second portioning hole.

4. The connector assembly of claim 2, wherein the receiving portion defines a plurality of receiving holes, the inserting portion comprises a plurality of inserting portions to be electrically inserted into the receiving holes.

5. The connector assembly of claim 1, wherein the first fixing member, the second fixing member, and the rods are made of iron.

6. The connector assembly of claim 1, wherein the first fixing member, the second fixing member, and the rods are made of silicon steel.

* * * * *